United States Patent [19]

Gentiluomo

[11] 3,940,145

[45] Feb. 24, 1976

[54] GOLF BALL

[76] Inventor: Joseph A. Gentiluomo, 1456 Belmont Ave., Schenectady, N.Y. 12308

[22] Filed: Feb. 28, 1974

[21] Appl. No.: 446,812

Related U.S. Application Data

[63] Continuation-in-part of Ser. No. 90,078, Nov. 16, 1970, abandoned.

[52] U.S. Cl. ..... 273/218; 273/220; 273/232; 273/199 R

[51] Int. Cl.[2] ..... A63B 37/02; A63B 69/36

[58] Field of Search ..... 273/220, 232, 218, 219, 273/183, 199, DIG. 5, DIG. 8

[56] References Cited

UNITED STATES PATENTS

| | | | |
|---|---|---|---|
| 1,591,117 | 7/1926 | Floyd | 273/220 |
| 3,313,545 | 4/1967 | Bartsch | 273/218 |
| 3,384,612 | 5/1968 | Brandt et al. | 273/218 X |
| 3,515,389 | 6/1970 | Wolfe | 273/199 R |

*Primary Examiner*—George J. Marlo

[57] ABSTRACT

A restricted trajectory golf ball which resembles a U.S.G.A. approved regulation long range golf ball. The ball construction comprises a spherical coherent impact damping mass operative in dissipating golf club impact energy such that limited rebound energy is available for ball propulsion. The surface contouring disposed upon the damping mass function to provide advantageous aerodynamic effects and may take the form of standard dimples or dimples which are deeper than standard. That is if surface dimples are used, the dimple depth can be adjusted to assist toward providing a ball having the required restricted trajectory. Due to physical and structural characteristics, the ball is characterized as being firm, substantially durable, exhibiting a "click" sound when hit, and having a flight range of approximately one-half to one-quarter the range of regulation balls when hit with a No. 1 Wood in the same manner and under the same weather conditions. Since the flight range of the invented ball is intermediate long range regulation and short range practice balls, it is ideal for use within small indoor and outdoor driving ranges or on short golf courses of the Par-3 type. When used on Par-3 courses, the courses can be converted to operate on a par rating basis equivalent to those of U.S.G.A. approved regulation golf courses so that attained scores can be considered representative of scores a golfer should attain on a regulation course of similar complexity.

12 Claims, 6 Drawing Figures

INVENTOR.
JOSEPH A. GENTILUOMO
BY Joseph A. Gentiluomo

GOLF BALL

This application is a continuation-in-part of application Ser. No. 90,078 filed Nov. 16, 1970, now abandoned.

Presently available limited range golf balls are of the unperforated and perforated shell type, of the coverless foam material type, and of the cellular or foamed material type having an extremely thin outer shell. Due to their inherently short flight range and extreme lightness, said balls cannot be used as game balls on short golf courses of the type herein disclosed.

The thin hollow shell type balls have a rather limited life because of collapsing and tearing induced by repeated golf club impact. These balls are not firm and can be easily hit Out-of-round. Also, said ball will not hold a true course when hit outdoors under windage or putted on a golf course putting green surface.

The cited foamed ball, either with or without a thin shell, also has substantially limited life due to tearing of the core and shell under repeated impact. Since said balls can be readily squeezed, it is obvious that they are of the "klunker" type which do not exhibit the "click" sound or the firmness preferred by golfers. Also, due to lightness, said balls will not hold a true course when hit outdoors under windage or when putted on a golf course type putting green having a grained surface texture.

Another type of ball extinct in use consists of a casing or shell of rubber filled with loose granulated cork, sawdust, or similar material.

Due to the said granular form of the cited fill material, the core will not have uniform structure and properties throughout, especially after being struck by a golf club. The ball will permanently distort or go out-of-round due to particle movement within, thus causing the core to be non-isotropic, with a noncentrally located center of gravity. This means that the said ball will exhibit poor and erratic flight stability such as uncontrollable hooks and slices. Also, said ball cannot be used for putting because of its tendency to roll erratically due to induced structural unbalance and out-of-roundness. Since said ball can be readily squeezed, it is of the "klunker" type.

The U.S.G.A. approved regulation wound type ball is constructed with a live center having vulcanized rubber thread wound around it under high tension, and a cover adhered over the said windings by heat treatment. The thread is practically pure natural rubber having just enough ingredients added to produce vulcanized rubber having the property of absorbing golf club impact energy and returning it very quickly with very little loss. Said thread resiliency is the property that makes the ball go.

This invention consists basically of a spherical impact damping means having surface contouring disposed thereupon. In operation, said damping means acts as a damper to restrict ball flight, whereas the resilient interior of a regulation long range ball acts as a "live center" to maximize the ball flight range. Field test results reveal that the flight range of the disclosed embodiments range from about one-half to about one-quarter that of regulation long range balls and approximately twice that of presently available short range practice balls.

The conventional long range ball is constructed with a live center which operates in an efficient manner to absorb golf club impact energy and return said energy instantly with very little loss, thereby propelling the ball away from the club head at a high velocity to provide for long range flight.

The medium range ball is constructed with a damping mass which operates in an inefficient manner when its distance performance is compared with that of a regulation long range ball. Said medium range ball operates by absorbing golf club impact energy and returning only a limited amount as rebound energy. The magnitude and release rate of said rebound energy is such that the ball leaves the golf club head at a relatively low velocity compared to velocities associated with regulation balls.

Since the flight range of the invention is intermediate long range regulation and short range balls, it is classifiable as a medium range ball. Said medium range ball presents many advantages when constructed to U.S.-G.A. size and weight specifications. It can be utilized within small indoor and outdoor driving ranges, and on short golf courses. When used outdoors on a windy day, said medium range ball will provide better ball performance than is possible with the presently available lightweight practice balls. Also, said ball is superior to said practice balls in holding a true course when putted on a golf course putting green having a grained textured surface. Due to the restricted trajectory provided by the said medium range ball, building height and floor space can be kept to a minimum to provide substantial savings in building costs.

Building height is kept to a minimum through the aerodynamic effect of the patterned surface contouring of the said medium range ball. This means that if the dimple depth of any of the herein disclosed balls were increased beyond the standard depth common to long range regulation balls, the ball would encounter substantially more air resistance while in flight, thereby reducing ball backspin. This reduction in backspin will operate to decrease the air velocity above the ball, thereby causing an increase in pressure. Also, at the bottom of the ball, the velocity of the opposing air currents is increased and the pressure is therefore decreased. The net affect opperates to reduce the dynamic lift on the ball, thereby causing a reduction in ball trajectory height. Due to the affected decrease in said trajectory height, the time the ball is sustained in flight is decreased, thus operating to reduce the ball's horizontal flight range such that overall building dimensions for said indoor driving ranges can be substantially reduced.

It can now be readily discerned that the reduction in ball trajectory height is achieved by providing said impact damping means with surface dimples deeper than those used on regulation long range golf balls. This means that reduced horizontal flight range can be attained through the use of a high impact damping means in conjunction with dimples of standard depth or with dimples deeper than standard depth.

Presently available short courses called Par-3 golf courses, are a cut-down version of the regulation course. These courses average about 1800 yards for 18 holes compared to an average of about 6300 yards for standard regulation courses. According to the 1961 National Golf Foundation survey of Par-3 courses, the shortest course was 630 yards and the longest course was 2840 yards in total length. One these courses the golfer in unable to use all the golf clubs utilized on a standard regulation course. However, due to the optimum limited flight range provided by the medium range ball, the golfer can now use every club in his bag and still experience the challenge and satisfaction obtained on a regulation full length course. This means that with the use of standard U.S.G.A. approved golf clubs, short golf courses can be established on a par rating basis equivalent to those of regulation full length courses so that attained scores can be considered representative of scores a golfer should attain on a long range course of similar complexity.

It now becomes apparent that the intent of this invention is to provide a medium range ball having a flight range intermediate long range and short range practice balls so as to fill the intermediate flight range void necessary for the establishment of feasible and challenging small indoor or outdoor golf driving ranges, and short golf courses.

Accordingly, object of this invention are as follows:

To provide a medium range golf ball capable of being propelled by U.S.G.A. approved standard type golf clubs a substantially decreased distance when compared to distances obtained with long range regulation balls.

To provide a medium range golf ball having external features resembling a regulation long range ball.

To provide a firm medium range golf ball of optimum physical and structural properties for producing a "click" sound when hit.

To provide a medium range golf ball having a spherical impact damping means for dissipating golf club impact energy so that limited rebound energy is available for ball propulsion.

To provide a medium range golf ball that offers at least the minimal optimum trajectory flight time preferred by golfers for experiencing the satisfaction associated with watching ball flight.

To provide a medium range golf ball that will give stable flight trajectory and putting performance.

To provide a medium range golf ball having isotropic characteristics such that its center of gravity is centrally located.

To provide a medium range golf ball with a dimpled outer surface for substantially reducing the accentuated affect of flight instability associated with hollow perforated shell type balls.

To provide a medium range golf ball exhibiting similar aerodynamic characteristics associated with regulation type long range balls.

To provide a medium range golf ball adaptable for use on a small indoor and outdoor driving range, and on short golf courses.

To provide a medium range golf ball with surface dimples deeper than those prevailing on regulation long range balls for reducing ball trajectory height.

To provide a medium range golf ball in which the ball line-of-roll will hold a substantially true course when putted with U.S.G.A. approved standard type putters on a regulation type golf course putting green having a grained texture.

To provide a relatively inexpensive medium range golf ball of size equivalent to that of a regulation long range ball.

To provide a medium range golf ball that can be manufactured to U.S.G.A. size and weight specifications.

These objects and other ojects of this invention should be discerned and appreciated from the description and claims taken in conjunction with the accompanying drawing in which:

Figure 1:
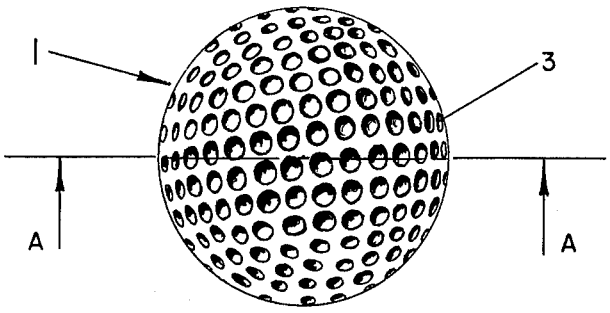
FIG. 1 shows a perspective view of the medium range golf ball.

Terms herein utilized should bear interpretation as follows:

U.S.G.A.- United States Golf Association.

Regulation Golf ball— It is a ball approved by the U.S.-G.A with specifications such that the ball size be a minimum of 1.680 inches in diameter, the ball weight be a maximum of 1.62 oz., and the initial ball velocity be not greater than 250 feet per second (plus 2% tolerance) based on the first 20 feet of ball travel when tested by the U.S.G.A. standard machine under specified conditions.

Published field tests conducted outdoors in calm weather at temperatures between 70 to 90 degrees Fahrenheit on regulation balls hit with identical force with a No. 1 Wood from a mechanical driving machine devised by Battele Memorial Institute, reveal that the average ball carry distance obtained by four well known regulation golf balls was 228, 239, 241, and 247 yards, respectively.

Range—It relates to the distance a ball carries on-the-fly when hit.

Regulation Golf Clubs—It relates to clubs used for hitting of regulation long range golf balls.

Short Range Practice Golf Ball—It is a ball capable of being propelled approximately one-eighth to one-tenth the distance of a regulation ball when hit in the same manner and under equivalent weather conditions used for testing said regulation ball.

Medium Range Golf Ball—It is a ball capable of being propelled approximately one-half to one-fourth the distance of a regulation ball when hit in the same manner and under equivalent weather conditions used for testing said regulation ball.

Regulation Golf Course—It is a golf course conforming to U.S.G.A. standards for computing par, based on the use of U.S.G.A. approved balls and clubs. Mens par being established such that hole lenghts up to 250 yards are rated Par-3, from 251 to 470 yards as Par-4, and from 471 yards and over as Par-5. These courses average about 6300 yards in total lenght for 18 holes.

Short Golf Course—It is a golf course wherein no individual hole exceeds the maximum of 250 yards set by the U.S.G.A. These courses average about 1800 yards in total lenght for 18 holes.

Impact Damping Means For Dissipating Golf Club Impact Energy—It pertains to impact damping means that have the capability of absorbing impact energy and dissipating it to the surroundings as heat to yield low rebound energy. Said impact damping means may exist as a one-piece unit of impact damping material, or as a multi-piece unit having a center of impact damping material and a cover which may or may not be a damping material.

Knitted Fiber Mesh— A structure consisting of a multipicity of interlocking spring-like fiber loops. Said knitted mesh can be formed into any desired size and shape with multidirectional orientation. This material possesses excellent damping properties because of the internal friction generated between the fibers when deformed.

Cork— Natural cork is composed of an aggregation of minute air vessels having thin but very strong walls. There are approximately 200 million tiny air-filled cells per cubic inch so that more than 50 per cent of its volume is captive air. Cork is used both in its natural form or as composition cork. Composition cork is made by bonding together cork particles at high pressure under the influence of heat. By controlling the bonding process, several densities can be produced depending on the amount of compression and the type of binder used. Cork particles are often bonded together with a rubber binder to yield resilient composition cork. Special light quality composition cork has a density of 9–10 lbs. per cubic foot, light quality has a density of 13–14 lbs. per cubic foot, medium quality has a density of 15–16 lbs. per cubic foot, and hard pressed heavy quality has a density of 18–20 lbs. per cubic foot.

Figure 2:
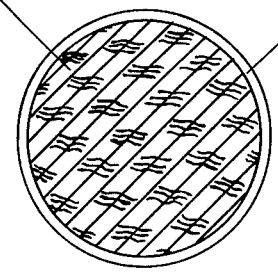
FIG. 2 shows one form of the golf ball taken as a sectional view along line A—A of FIG. 1.

The first embodiment of the invention shown in FIG. 2 consists of an impact damping material such as natural cork core 4 encapsulated by a substantially thick dimpled cover 2, such as Surlyn an ionomer resin material. Said cover can be made from 0.025 to 0.075 of an inch thick. It is to be understood that said core 4 can also be made from coherent composition cork.

Figure 3:
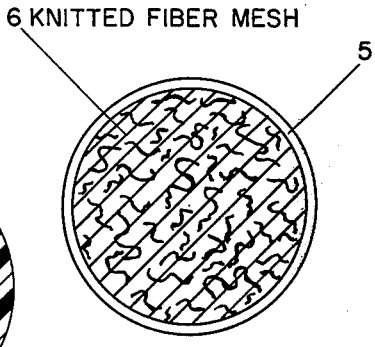
FIG. 3 shows a second form of the golf ball taken as a sectional view along line A—A of FIG. 1.

A second embodiment of the invention shown in FIG. 3 consists of an impact damping material such as knitted metallic fiber mesh core 6 encapsulated by a substantially thick dimpled cover 5, such as 0.025 to 0.075 of an inch thick Surlyn an ionomer resin material. In the manufacture of said core 6, wire is first knitted into a mesh structure consisting of a multiplicity of interlocking spring-like loops. The required amount of mesh structure is then formed into the desired size and shape to provide a multidirectional orientation of steel wire spring loops. When impact load is applied to the ball, the strands of the mesh rub on each other and damping is accomplished. Cited knitted wire mesh is equivalent to that used in vibration and shock isolators manufactured by companies such as Barry Control Div. of Barry Wright Corp., Schuyler Mfg. Corp., ACS Ind. Inc., and American Copper Sponge Co. Inc. It is to be understood that the said knitted mesh could be made from materials other than steel.

Figure 4:
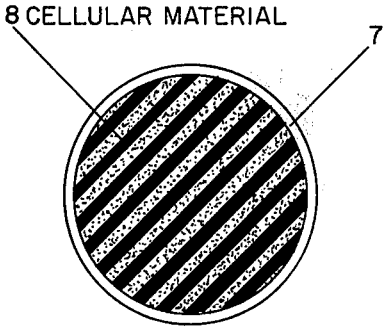
FIG. 4 shows a third form of the golf ball taken as a sectional view along line A—A of FIG. 1.

A third embodiment shown in FIG. 4 consists of impact damping polyurethane such as cellular or foamed polyurethane 8 encapsulated by a substantially thick dimpled cover 7, such as 0.025 to 0.075 of an inch thick Surlyn an ionomer resin material. Said core 8 can be made from formulations such as 90-585/34-841, 90-635/34-841, and 90-646/34-841 provided by Reichhold Chemicals, Inc., and HC-2/30, HC-3/40, and BX-326-4 provided by Stepan Chemical Co. Cited formulations can be used to mold said core with a thin integral skin. However, a thin integral skin is not essential. Also, other materials such as foamed polyethylene, polyvinyl chloride, polystyrene, etc. can be used. It is to be noted that formulations having densities less than those associated with above cited formulations can be utilized with cover thicknesses appropriately greater than herein cited. Also, to be noted is the fact that said core can be made of solid damping materials such as butyl, polysulfide, etc.

Figure 6:
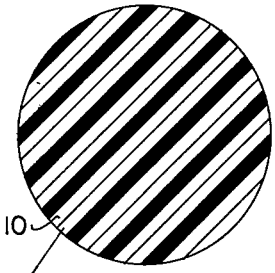
FIG. 6 shows a fifth form of the golf ball taken as a sectional view along line A—A of FIG. 1.

A fourth embodiment shown in FIG. 6 is a molded one piece solid ball fabricated from an impact damping composition 10 consisting essentially of 100 parts of the low resilient elastomer Butyl, approximately 40–70 parts of a monomer such as Butylene Glycol Dimethacrylate, approximately 20–60 parts of fillers such as fine Silica(HiSil 233) and 60 mesh or less granulated Cork, and 0.5–10 parts of a curing agent such as Dicumyl Peroxide.

Instead of Butyl, long range regulation one piece molded balls use highly resilient materials such as Cis-polybutadiene, Cis-butadiene, etc. Resiliency tests conducted on a Bashore resiliometer indicate that Cis-polybutadiene has a percentage rebound of 85–90, and Butyl has a percentage rebound of 18–25. Therefore, when Butyl is substituted for said Cis-polybutadiene and Cis-butadiene in the compositions presently being used to provide solid one piece regulation balls, the results will be a composition for the manufacture of medium range golf balls.

For example, the following medium range ball composition is similar to that of a commercially available regulation ball with the exception that the Cis-polybutadiene elastomer is replaced by Butyl.

1. 100 parts of Butyl
2. 56.2 parts of Butylene Glycol Dimethacrylate
3. 37.5 parts of Silica
4. 6.2 parts of Cork
5. 3.13 parts of Dicumyl Peroxide During ball manufacture, the above cited ingredients are thoroughly mixed on rubber rolls or a Banbury mixer at room temperature to a homogeneous composition. This material is then made up into slugs of suitable weight for insertion into the golf ball molds. Molding is effected at pressures of from 125 to 300 psi at a mold temperature of about 300° Fahrenheit with a molding time of about 10 minutes.

For convenience in expressing proportions of ingredients of the above cited composition, said ingredients were given as parts by weight based on 100 parts by weight of the elastomer.

Figure 5:
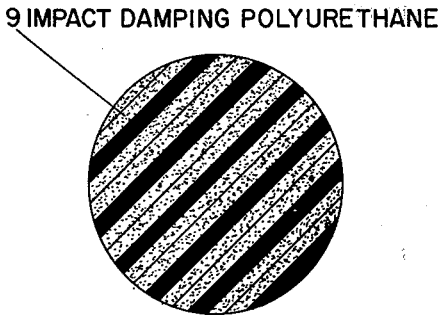
FIG. 5 shows a fourth form of the golf ball taken as a sectional view along line A—A of FIG. 1.

Another one piece ball, representable by FIG. 5, is manufacturable by a one-step process which simultaneously molds the damping material to form a foamed core 9 having a surface contoured dense integral cover exhibiting a high degree of cut and abrasion resistance. An impact damping material such as foamed polyurethane can be molded with a substantially thick and tough solid integral self-formed layer surrounding the foamed core. Due to modern molding techniques and advanced chemical formulations, the core density can be varied to suit requirements and the said integral solid layer produced during the foaming reaction can be controlled to a thickness ranging from about one thirtysecond to one-eighth inches. The unique advantages of polyurethane foam are that stiffness, resiliency, and density can be independently controlled to provide the physical and structural properties required for the manufacture of medium range balls. This ball can be made from a formulation such as 90-585/34-841 Polylite provided by Reichhold Chemicals, Inc. Said formulation can yield a ball with an overall molded density of 10–16 pcf including an integral layer of about one-sixteenth of an inch having a denisty of 50–70 pcf and a surface hardness of 50–60 Shore D.

Also, this ball can be made from other formulations such as 90-635/34-and 90-646/34-841 provided by Reichhold Chemicals, and formulations HC-3/40, HC- 5/60, and BX-326-4 provided by Stepan Chemical Co. It is to be noted that with these formulations lower foam density balls will require a thicker integral layer, and higher foam density balls will require a thinner integral layer to provide a ball with the herein specified flight range. Also, other formulations with lower mold densities can be used providing an integral dense layer of appropriate thickness is provided. With above cited formulations, overall molded densities can range from 4–45 pcf, integral layer densities can range from 50–70 pcf, and the surface hardness can range from 50–80 Shore D.

It is to be noted that all disclosed embodiments include patterned surface contouring of such design and dimensions that when operating in conjunction with said impact damping means will yield a ball that can be propeled with regulation golf clubs a distance of one-quarter to one-half the distance obtained with a regulation ball. For example, the presently used standard dimple can be made deeper to assist toward providing the required restricted ball trajectory.

All of the herein disclosed golf ball embodiments are finished in the conventional manner. That is, balls may be given a white primer and then one or two coats of tough polyurethane enamel. After brand and indentification marks are printed on the balls, clear urethane varnish may be used to proof them against scuffing and staining.

It is to be noted that a swing that drives a regulation ball 220 yards on the carry, will drive a medium range ball depending on its built-in physical and structural properties, from 165 to 330 feet under equivalent test conditions.

Having thusly described the invention, the following is claimed:

1. A medium range golf ball, comprising impact damping means for dissipating golf club impact energy, and patterned surface contouring of such design and dimensions that when operating in conjunction with said impact damping means will yield a ball that can be propelled with regulation golf clubs an on-the-fly distance of one-quarter to one-half the distance obtained with a regulation golf ball when hit under identical conditions; said on-the-fly distance being such that when said medium range ball is played on short golf courses with said regulation golf clubs, said short courses can be converted to operate on a par rating basis equivalent to par of regulation golf courses of similar complexity.

2. The invention as defined in claim 1, wherein said means is further characterized as a one piece unit consisting essentially of butyl, butylene glycol dimethacrylate, fine silica, granulated cork, and dicumyl peroxide.

3. The invention as defined in claim 2, wherein said surface contouring is further characterized as patterned depressions.

4. The invention as defined in claim 1, wherein said means is further characterized as a one piece unit of impact damping polyurethane.

5. The invention as defined in claim 4, wherein said surface contouring is further characterized as patterned depressions.

6. The invention as defined in claim 5, wherein said depressions are further characterized as dimples.

7. The invention as defined in claim 1, wherein said means is further characterized as impact damping cork having a thick encapsulation, and said surface contouring is further characterized as patterned depressions contained within the surface of said encapsulation.

8. The invention as defined in claim 7, wherein said depressions are further characterized as dimples.

9. The invention as defined in claim 1, wherein said means is further characterized as an impact damping knitted fiber mesh having a thick encapsulation, and said surface contouring is further characterized as patterned depressions contained within the surface of said encapsulation.

10. The invention as defined in claim 9, wherein said depressions are further characterized as dimples.

11. The invention as defined in claim 1, wherein said means is further characterized as an impact damping cellular or foamed material having a thick encapsulation, and said surface contouring is further characterized as patterned depressions contained within the surface of said encapsulation.

12. The invention as defined in claim 11, wherein said cellular or foamed material is further characterized as rigid polyurethane foam, and said depressions are further characterized as dimples.

* * * * *